US008579680B2

(12) United States Patent
Schellenberg et al.

(10) Patent No.: US 8,579,680 B2
(45) Date of Patent: Nov. 12, 2013

(54) CENTERLESS GRINDING MACHINE

(76) Inventors: Dan Schellenberg, Beamsville (CA); Harry Schellenberg, Beamsville (CA)

( * ) Notice: Subject to any disclaimer, the term of this patent is extended or adjusted under 35 U.S.C. 154(b) by 362 days.

(21) Appl. No.: 12/813,630

(22) Filed: Jun. 11, 2010

(65) Prior Publication Data

US 2010/0323589 A1 Dec. 23, 2010

Related U.S. Application Data

(60) Provisional application No. 61/219,093, filed on Jun. 22, 2009.

(51) Int. Cl.
*B24B 5/18* (2006.01)

(52) U.S. Cl.
USPC ..... 451/242; 451/72

(58) Field of Classification Search
USPC ..... 451/242, 243, 72, 450, 182, 190, 194, 451/7, 53, 449, 244, 245, 387
See application file for complete search history.

(56) References Cited

U.S. PATENT DOCUMENTS

| | | | | | |
|---|---|---|---|---|---|
| 1,737,852 | A | * | 12/1929 | Kern | 451/242 |
| 1,837,821 | A | * | 12/1931 | Holmes | 451/242 |
| 1,938,765 | A | * | 12/1933 | Haas | 451/242 |
| 2,308,739 | A | * | 1/1943 | Binns | 451/242 |
| 2,322,620 | A | * | 6/1943 | Ekholm | 451/242 |
| 2,412,730 | A | * | 12/1946 | Heckethorn | 451/244 |
| 2,440,402 | A | * | 4/1948 | Horberg | 451/49 |
| 2,520,228 | A | * | 8/1950 | Thomte | 451/242 |
| 2,730,845 | A | * | 1/1956 | Hans | 451/49 |
| 2,889,666 | A | * | 6/1959 | Coes, Jr. | 451/283 |
| 2,950,580 | A | * | 8/1960 | Render | 451/242 |
| 2,990,656 | A | * | 7/1961 | Tompkins | 451/242 |
| 3,685,212 | A | * | 8/1972 | Schaller | 451/242 |
| 3,729,300 | A | * | 4/1973 | Mackay et al. | 451/242 |
| 3,859,755 | A | * | 1/1975 | Schaller | 451/5 |
| 4,091,571 | A | * | 5/1978 | Nilsson | 451/242 |
| 4,417,422 | A | * | 11/1983 | Redeker et al. | 451/143 |
| 5,121,571 | A | * | 6/1992 | Smarsh | 451/242 |
| 5,551,908 | A | * | 9/1996 | Harada | 451/72 |
| 5,558,567 | A | * | 9/1996 | Hedberg | 451/242 |
| 5,573,451 | A | * | 11/1996 | Tschudin | 451/243 |
| 5,795,212 | A | * | 8/1998 | Jacobs et al. | 451/36 |
| 6,110,010 | A | | 8/2000 | Pflager et al. | |
| 6,123,605 | A | * | 9/2000 | Yano | 451/49 |
| 6,176,766 | B1 | * | 1/2001 | Silverman | 451/243 |
| 6,371,100 | B2 | * | 4/2002 | Sekiya | 125/13.01 |
| 6,454,636 | B1 | * | 9/2002 | Iwabuchi | 451/53 |
| 6,569,000 | B1 | * | 5/2003 | Mushardt et al. | 451/72 |
| 6,729,938 | B2 | * | 5/2004 | Ikeda | 451/14 |
| 6,852,006 | B1 | * | 2/2005 | Gleason et al. | 451/11 |
| 6,950,718 | B2 | * | 9/2005 | Smarsh et al. | 700/164 |
| 7,147,542 | B2 | * | 12/2006 | Memmelaar et al. | 451/11 |

(Continued)

*Primary Examiner* — Joseph J Hail
*Assistant Examiner* — Marc Carlson

(57) ABSTRACT

A centerless grinding machine includes a frame with an upper base and includes a driven regulating wheel and a driven grinding wheel mounted to the frame. At least one of the wheels is mounted to the upper base and hangs downwardly from the upper base. At least one of the wheels is indexable laterally along an X direction. The wheels are for supporting and grinding a work piece placed between the grinding wheel and the regulating wheel. Preferably the upper base is spaced from and above the at least one wheel and the regulating wheel and the grinding wheel are operably mounted to the upper base such that the wheels hang downwardly from the upper base.

25 Claims, 10 Drawing Sheets

(56) References Cited

U.S. PATENT DOCUMENTS

| | | | | |
|---|---|---|---|---|
| 7,189,144 | B2 * | 3/2007 | Kamamura et al. | 451/11 |
| 7,223,159 | B2 * | 5/2007 | Tschudin et al. | 451/182 |
| 7,367,868 | B2 * | 5/2008 | Memmelaar et al. | 451/11 |
| 7,429,208 | B1 * | 9/2008 | Gleason et al. | 451/11 |
| 7,435,157 | B1 * | 10/2008 | Smarsh et al. | 451/5 |
| 7,677,954 | B2 * | 3/2010 | Hall et al. | 451/8 |
| 2005/0003739 | A1 * | 1/2005 | Deller | 451/21 |
| 2006/0119191 | A1 | 6/2006 | Aeschlimann et al. | |
| 2006/0121827 | A1 * | 6/2006 | Junker | 451/5 |
| 2008/0113594 | A1 * | 5/2008 | Carlson | 451/296 |
| 2010/0130106 | A1 * | 5/2010 | Hyatt et al. | 451/53 |

* cited by examiner

CENTERLESS GRINDING MACHINE

The applicant claims priority from regularly filed U.S. Provisional patent application 61/219,093 filed Jun. 22, 2009 under the title CENTERLESS GRINDING MACHINE by the inventors Harry Schellenberg and Dan Schellenberg.

FIELD OF THE INVENTION

The present invention relates to centerless grinding machines and particularly relates to a centerless grinding machine using electromagnetic linear drives for positioning the grinding wheel and the regulating wheel, and structure to minimize thermal deviation.

BACKGROUND OF THE INVENTION

Heat is generated during the material removal when grinding a work piece to a desired measure between a grinding wheel and a regulating wheel. In addition to the heat, the centerless grinding machine also produces a lot of grinding chips and/or particles which are removed during the grinding process. In order to control the heat generation as well as the generation of debris produced by the centerless grinding machine normally a coolant is applied to the machine in order to cool the components of the centerless grinding machine and also to carry away the debris generated by the grinding process.

The heat generation results in unwanted thermal expansion of various components and structure of the centerless grinding machine which can affect the final accuracy of the ground dimensions of the work piece. In addition, the debris can be detrimental to moving components of the centerless grinding machine; in particular metallic particles are extremely detrimental to the operation of electro magnetic linear motors. Fluids and coolants naturally flow downwardly due to gravity and therefore coolant is normally applied from above and collected below. Unfortunately most of the complex drive components and drive systems of conventional centerless grinding machines are also mounted below the grinding and regulating wheels. The conventional method of mounting and driving the grinding wheel and the regulating wheel makes it very difficult to utilize electromagnetic linear drive systems since they potentially are most vulnerable to penetration of coolant and the debris and particles entrained within the coolant, thereby negatively impacting the efficiency and accuracy of the electromagnetic linear drive systems mounted in the conventional manner and locations.

U.S. Pat. No. 5,558,567 filed by Olle Hedberg on Feb. 14, 1995 and which issued on Sep. 24, 1996 under the title Centerless Machines, describes a centerless grinding machine which attempts to minimize the thermal deviation created in the centerless grinding process. In particular the specification describes a grinding carriage and a regulating carriage which is arranged in an overlap relation, such that one supporting point of one of the carriage is situated between two supporting points of the other carriage thereby compensating thermally dependent length variations of the carriages. This specification also describes the possibility of using electromagnetic linear motors.

The Hedberg specification however does not discuss how the flow of coolant and/or the structure can be optimized in order to minimize thermal variations and errors, or how the electromagnetic linear motors can be arranged in such a manner in order to minimize the impregnation of particles and debris into the linear motors.

BRIEF DESCRIPTION OF THE DRAWINGS

The present invention will be described by way of example only with reference to the following drawings in which.

DETAILED DESCRIPTION OF THE PREFERRED EMBODIMENT

Definitions

"Driven grinding wheel" referred to herein includes the grinding wheel and grinding wheel drive motor combination.

"Driven regulating wheel" referred to herein includes the regulating wheel and regulating wheel drive motor combination.

Figure 1:
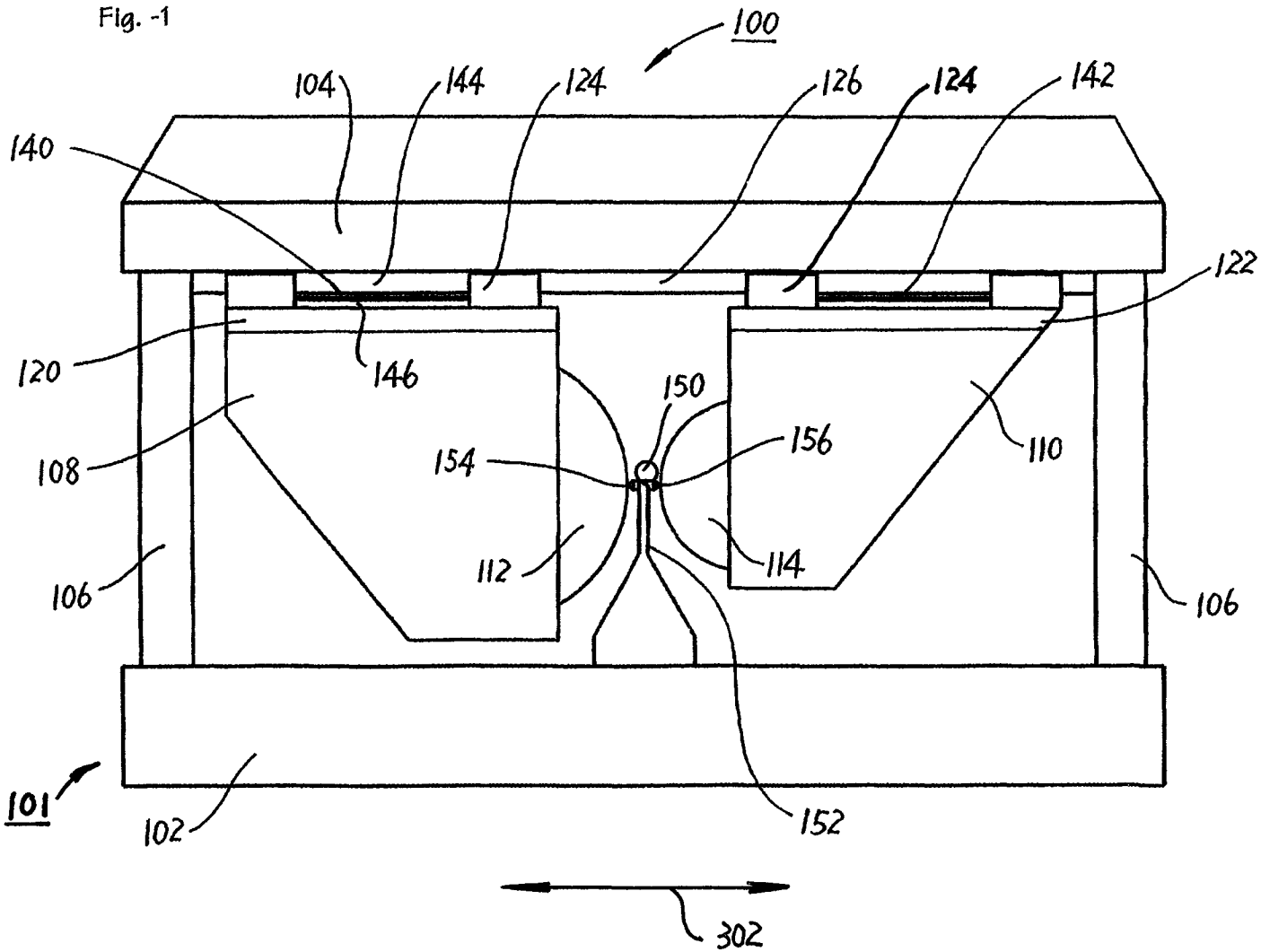
FIG. 1 is a schematic side elevational view of the centerless grinding machine.
Figure 4:
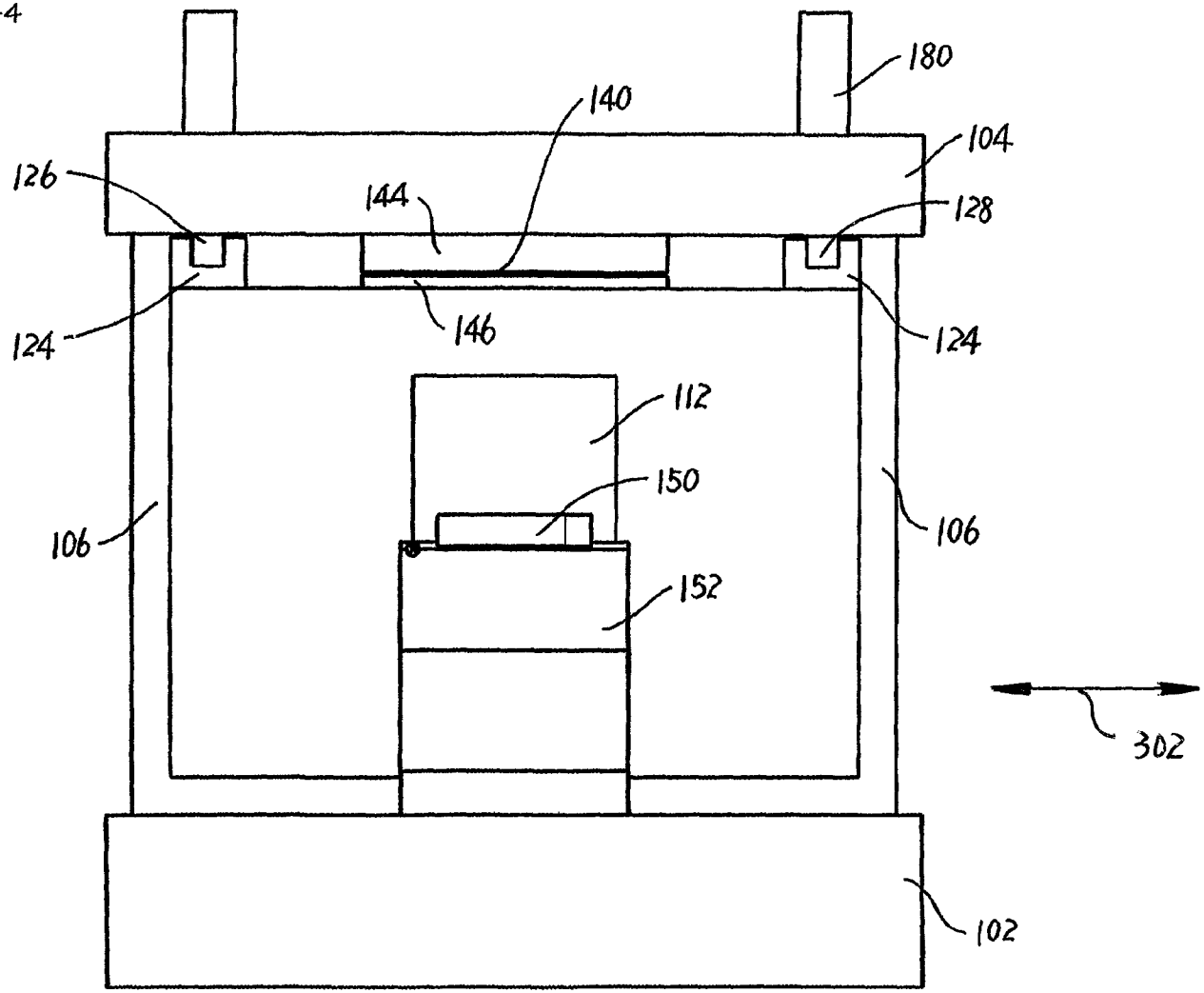
FIG. 4 is a schematic end elevational view of some selected components of the centerless grinding machine.

The centerless grinding machine is shown generally as 100 in the Figures and includes the following major components namely a frame 101 including a lower base 102, upper base 104, end supports 106, grinding wheel housing 108, a regulating wheel housing 110, driven grinding wheel 112 and driven regulating wheel 114. The mounting of the wheels 112 and 114 to the frame 101 is now described by way of example only. Grinding wheel housing 108 is mounted onto a grinding wheel saddle plate 120 and regulating wheel housing 110 is mounted onto regulating wheel saddle plate 122. Saddle plates 120 and 122 in turn are mounted onto linear rail saddles 124 which may be for example recirculating roller ball bearings which are slideably or rollably mounted onto a first linear rail 126 and a second linear rail 128. A set of linear rails namely first and second linear rails 126 and 128 are mounted onto upper base 104 as schematically shown in FIGS. 1 and 4. The mounting as described above by way of example only of one or more of the wheels to the upper base 104 of frame 101 positioned above the regulating wheel 114 is an important feature. Many other mounting and or connection arrangements are possible such that the wheels are mounted to the frame 101 at a position above the regulating wheel 114. Described herein is one possible mounting arrangement.

The term "wheels" referred to herein refers only to the regulating wheel 114 and grinding wheel 112. A horizontal plane is defined as any parallel plane having a X direction 302, and a Y direction 302 as depicted in FIGS. 1 and 4 which is a plane substantially horizontal in the normal sense of the word namely parallel to the plane of the horizon. The frame 101 has mounted thereto regulating wheel 114 and a grinding wheel 112. The frame 101 preferably includes an upper base 104 oriented along a horizontal plane and at least one of the wheels 112, 114 is mounted to the upper base 104 and hangs downwardly from the upper base 104 as shown in the figures. At least one of the wheels is indexable longitudinally or also referred to herein as laterally along an X direction which lies within a horizontal plane 302. The wheels 112 and 114 are for supporting and grinding a work piece placed between the grinding wheel 112 and the regulating wheel 114. Longitudinally and laterally are used interchangeably in this specification to denote extending along the X direction.

Grinding wheel 112 is moved or indexed laterally by a grinding wheel linear motor 140 and regulating wheel 114 is moved or indexed laterally by a regulating wheel linear motor 142. Electro magnetic linear motors 140 and 142 include a motor coil 144 and a magnetic way 146. The linear motors are mounted onto upper base 104 to move the wheels 112 or 114 relative to the upper base 104. In the present example this means that the motor coil 144 is mounted to upper base 104. It is possible to have for example the reverse namely the magnetic way mounted 146 mounted to upper base 104.

A work piece 150 is supported by a work piece support 152 and includes a dressing device which is a grinding wheel dressing diamond 154 and a regulating wheel dressing diamond 156. The drawings depict a dressing diamond attached to the work piece support, however in practice any other dressing devices known in the art may be employed including a rotary dressing wheel, a dressing diamond, including a cluster point diamond, a single point diamond, or a blade style diamond.

Figure 2:
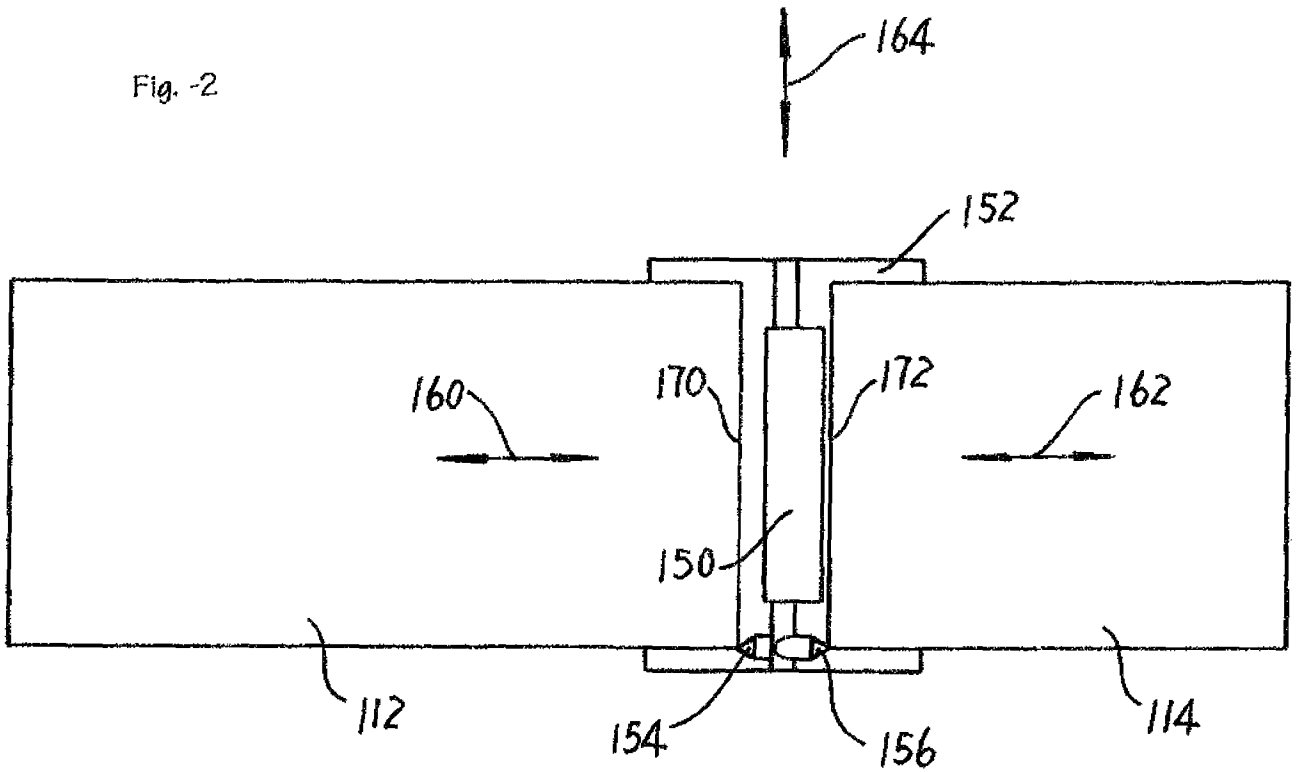
FIG. 2 is a partial schematic top plan view of some selected components of the centerless grinding machine.
Figure 3:
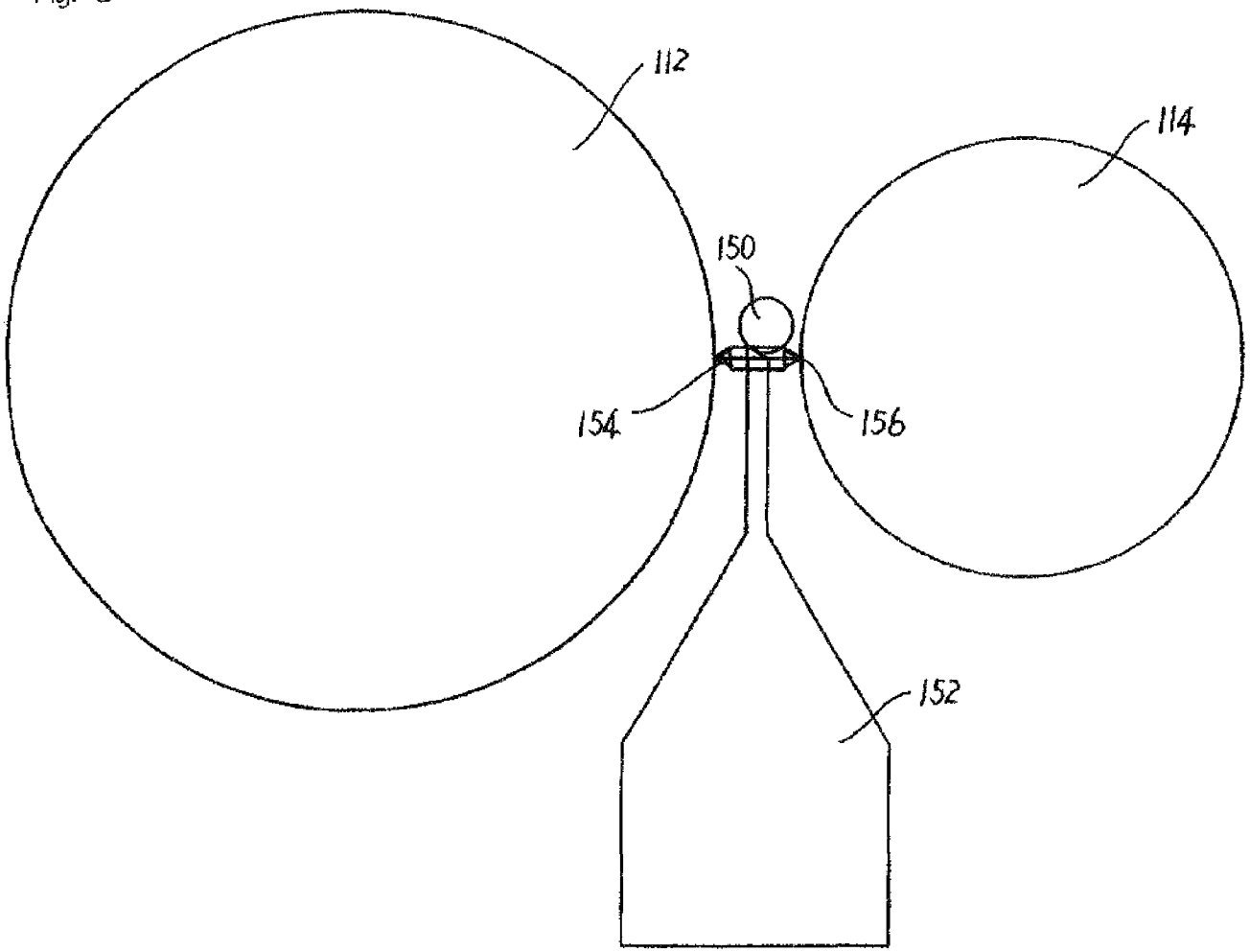
FIG. 3 is schematic side elevational view of some selected components of the centerless grinding machine.

Referring now to FIG. 2, grinding wheel 112 moves along first and second linear rails 126 and 128 in the lateral X grinding direction 160. Regulating wheel 114 also moves along the linear rail 126 and 128 laterally along X regulating direction 162.

In order to dress the grinding wheel 112 and the regulating wheel 114, grinding wheel dressing diamond 154 is moved along the grinding face 170 in the Y dressing direction 164. In similar fashion the regulating wheel 114 is dressed by moving regulating wheel dressing diamond 156 along regulating face 172 along Y dressing direction 164. The work piece support is moved in the Y dressing direction 164 using a conventional drive such as a ball screw drive having a rotary position encoder (not shown).

As described above, the grinding wheel 112 and the regulating wheel 114 are moved along the X direction shown as 160 and 162 preferably using electromagnetic linear motors 140 and 142 as will be described in more detail below. It may however also use other indexing drives including ball screw type drives known in the art.

Figure 5:
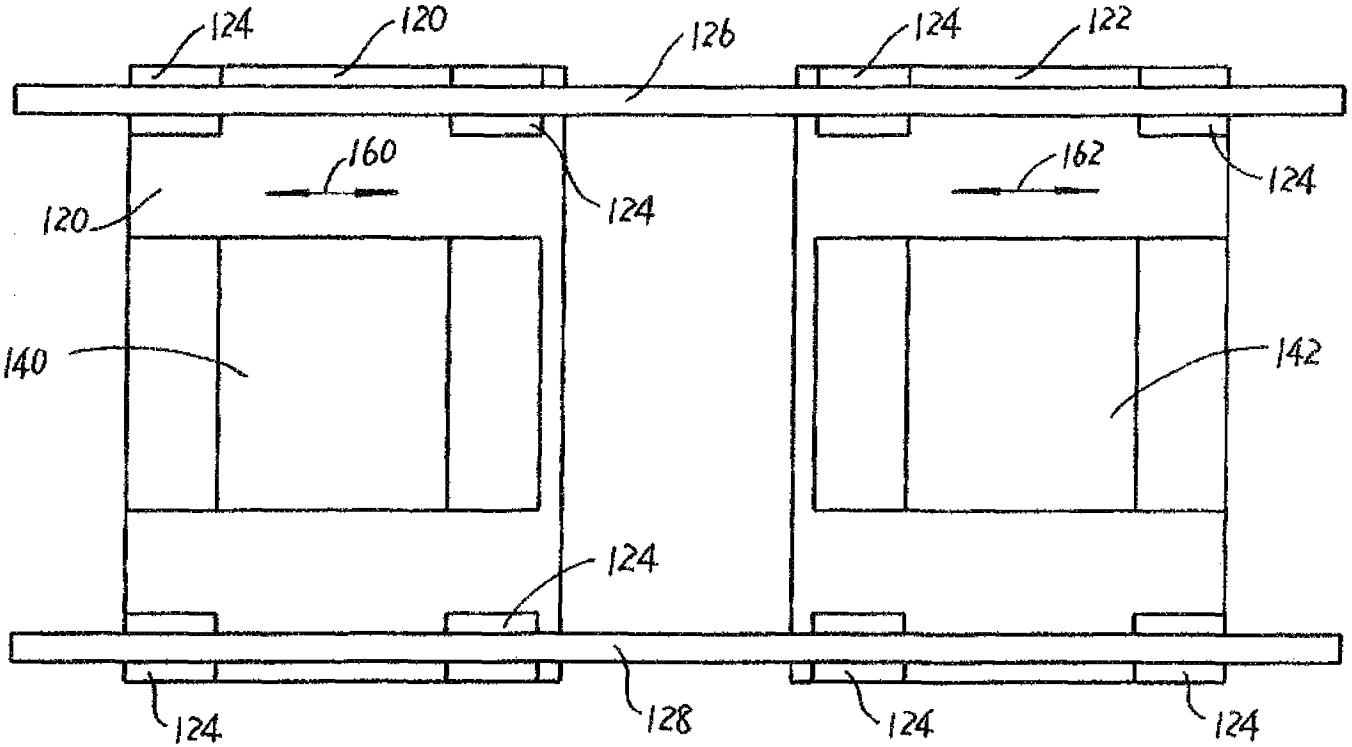
FIG. 5 is a top plan view of some selected components of the centerless grinding machine.
Figure 6:
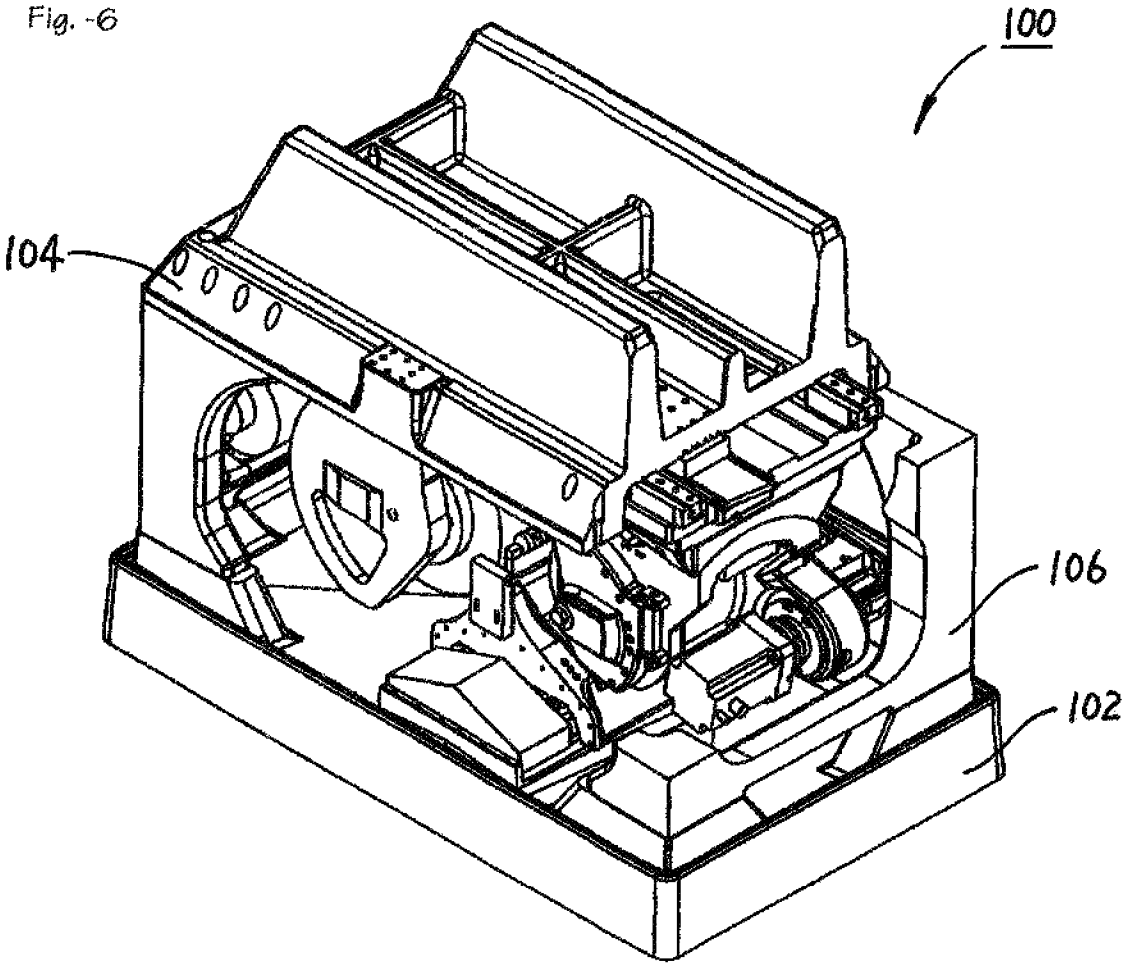
FIG. 6 is a schematic top partial cut away perspective view of the centerless grinding machine.

Referring now to FIG. 5 which depicts first linear rail 126 and the second linear rail 128 with linear rail saddles 124 mounted thereon. First linear rail 126 is preferably positioned parallel to and spaced from second linear rail 128 as shown in FIG. 5. In this manner first linear rail 126 and second linear rail 128 is common to both grinding wheel 112 and the regulating wheel 114 and the lateral movement of the grinding wheel 112 and the regulating wheel 114. Linear rail saddles 124 include linear bearings such that they rollably move along first and second linear rails 126 and 128.

Grinding wheel saddle plate 120 is mounted onto four linear rail saddles 124 which roll along first and second linear rails 126 and 128. Similarly regulating wheel saddle plate 122 is mounted onto four linear rail saddles 124 as shown in FIG. 5, such that regulating wheel saddle plate 122 rolls along first and second rails 126 and 128. Coolant normally flows from above onto the work piece and the work piece support and across the grinding face 170 and the regulating face 172 of grinding wheel 112 and 114.

In this manner cooling fluid flows downwardly away from the drive mechanism namely away from grinding wheel linear motor 140 and regulating wheel linear motor 142 of the grinding wheel 112 and the regulating wheel 114.

Debris and particles entrained in the coolant fluid flow away from the drive systems of both the grinding wheel 112 and the regulating wheel 114 and in particular this arrangement minimizes the penetration and entrapment of debris onto linear rails 126, 128 linear rail saddles 124, and grinding wheel linear motor 140 and regulating wheel linear motor 142.

A person skilled in the art will note that the lateral drive system for the regulating wheel 114 is mounted from above. In other words the grinding wheel saddle plate 120 and the regulating wheel saddle plate 122 are hung from above onto with the linear rail saddles 124 which in turn are mounted onto common first linear rail 126 and second linear rail 128 such that wheels 112 and 114 extend downwardly from the upper base as shown in FIG. 1. Upper and lower is the position relative to the regulating wheel. Therefore upper base 104 is positioned above regulating wheel 114.

By providing for common linear rails 126 and 128 one reduces the set up time and construction of the centerless grinding machine and also ensures greater accuracy in determining and ensuring that the path ways of the grinding wheel 112 and the regulating wheel 114 are set up parallel to each other.

Figure 9:
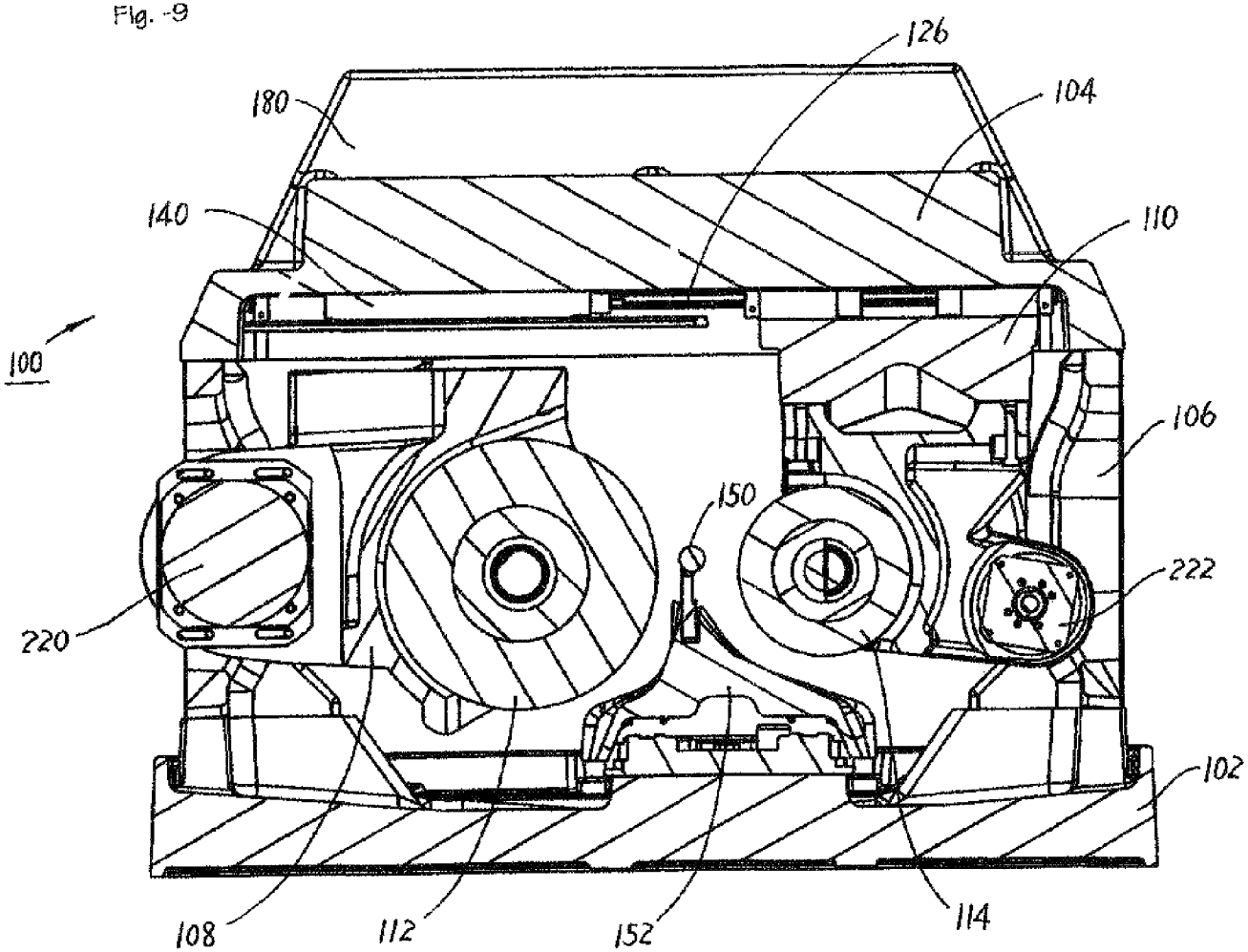
FIG. 9 is a schematic cross sectional side elevational view of the centerless grinding machine.

In order to provide for a stiffer structure, stiffening ribs 180 as shown in FIG. 9 are utilized which are attached to the upper base 104.

Figure 7:
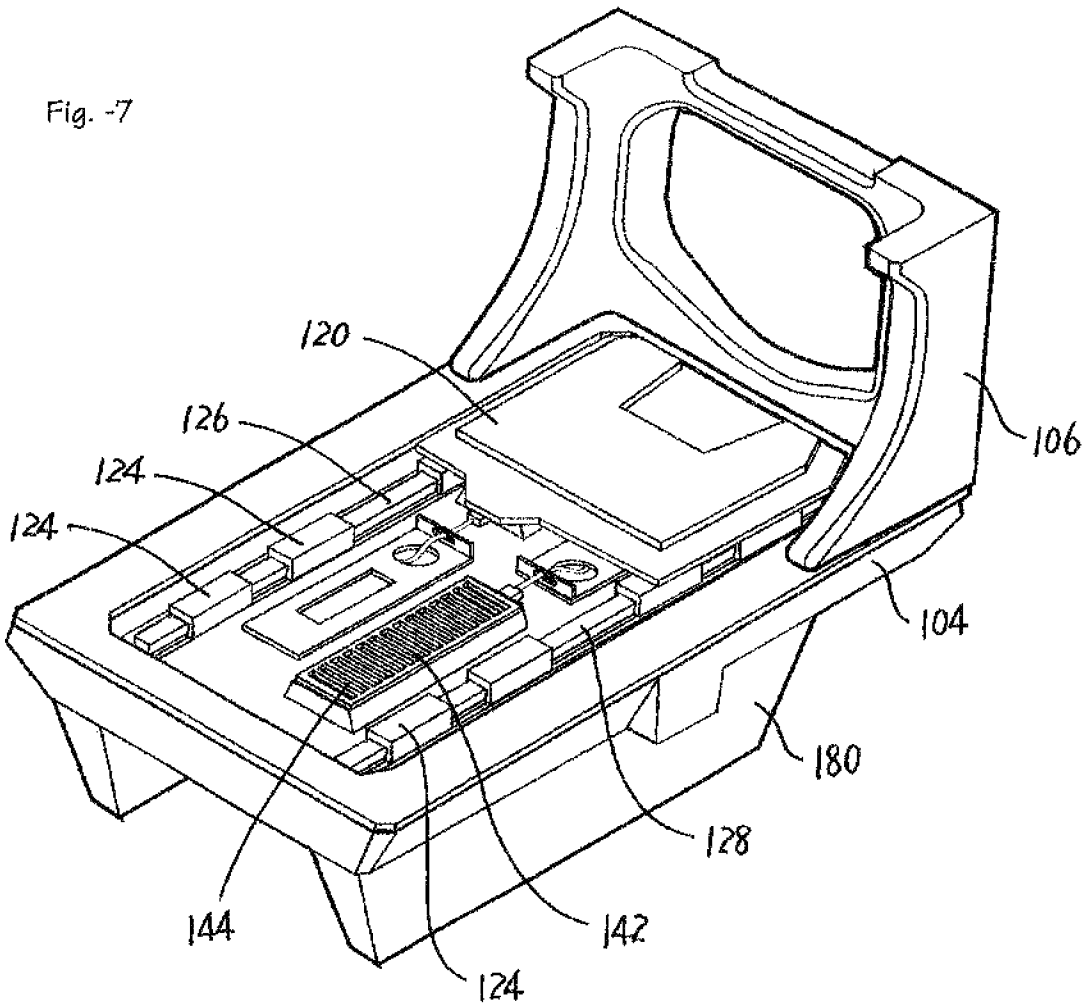
FIG. 7 is an interior schematic perspective view of the upper base in inverted position showing some selected components.
Figure 8:
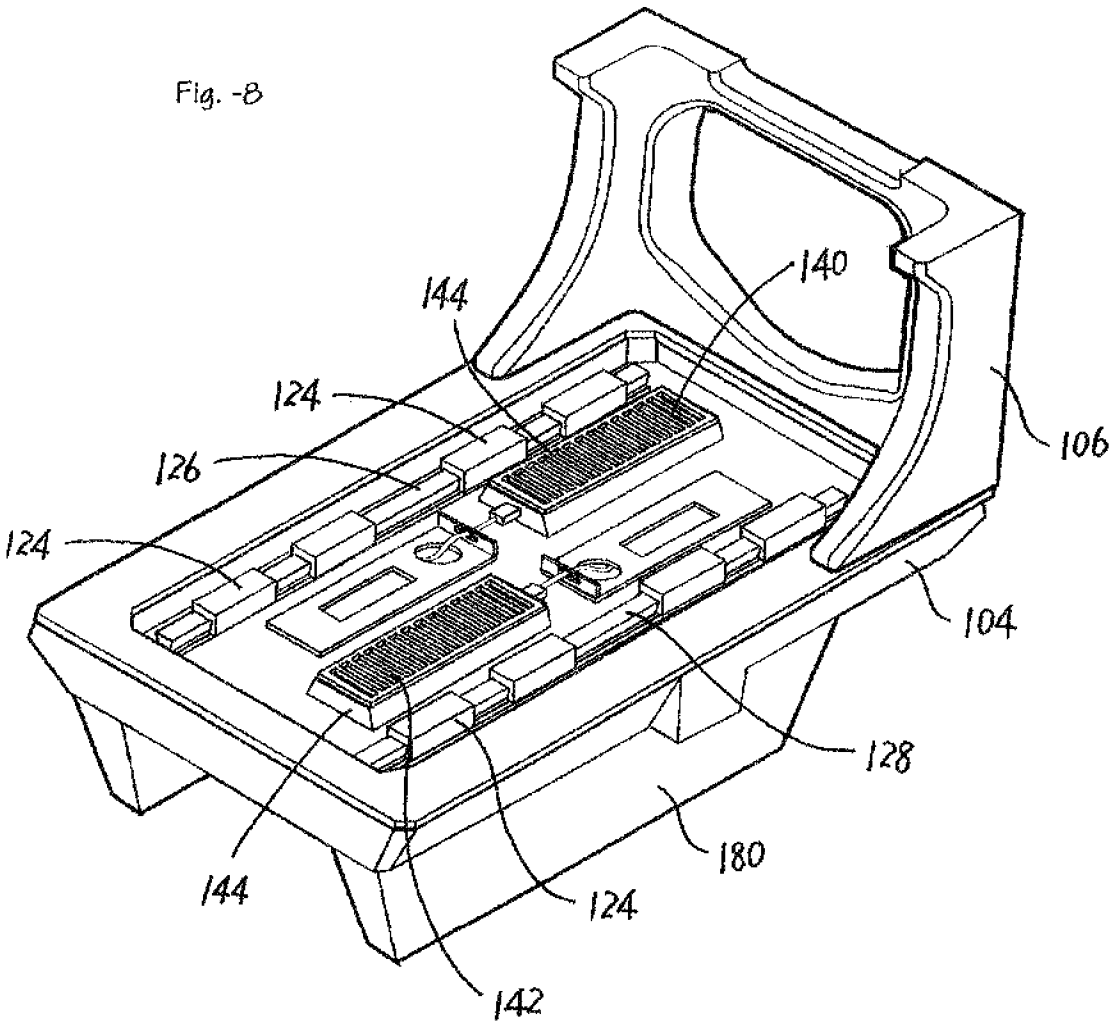
FIG. 8 is an interior schematic perspective view of the upper base in inverted position showing some selected components.

Referring now to FIG. 7 which is a partial schematic perspective view of the upper base 104 inverted thereby revealing the components mounted to the under surface of the upper base 104. In FIG. 7 for example, one can see the first linear rail 126 and the second linear rail 128 mounted onto the under surface of upper base 104. The figure also shows a number of linear rail saddles 124 mounted onto the linear rails 126 and 128. FIG. 7 shows the motor coil 144 of regulating wheel linear motor 142 as well as a part of motor coil 144 of grinding wheel linear motor 140.

In addition, FIG. 7 also shows the grinding wheel saddle plate 120 mounted onto linear rail saddles 124.

Grinding wheel housing 108 preferably is mounted onto grinding wheel saddle plate 120 thereby securely mounting grinding wheel 112 onto the upper base 104 in rollable fashion with suitable bearings.

Referring now to FIG. 9 the centerless grinding machine 100 is shown in a schematic cross sectional view revealing a number of the internal components. FIG. 9 depicts lower base 102 having mounted thereon end supports 106 which in turn has mounted thereon upper base 104.

Mounted in rollable fashion to upper base 104 is grinding wheel housing 108 which includes grinding wheel 112 which is driven in rotary fashion by grinding wheel drive motor 220. Driven grinding wheel referred to herein is the combination of the grinding wheel drive motor 220 connected to the grinding wheel 112. Grinding wheel housing 108 is moved laterally with grinding wheel linear motor 140.

Also mounted to the underside of upper base 104 is regulating wheel housing 110 which includes regulating wheel 114 being driven in rotary fashion by regulating wheel drive motor 222. Driven regulating wheel referred to herein is the combination of the regulating wheel drive motor 222 connected to the regulating wheel 114. FIG. 9 also depicts work piece 150 being supported by work piece support 152. During the grinding operation the work piece 150 is supported between the grinding wheel 112 and the regulating wheel 114.

Figure 10:
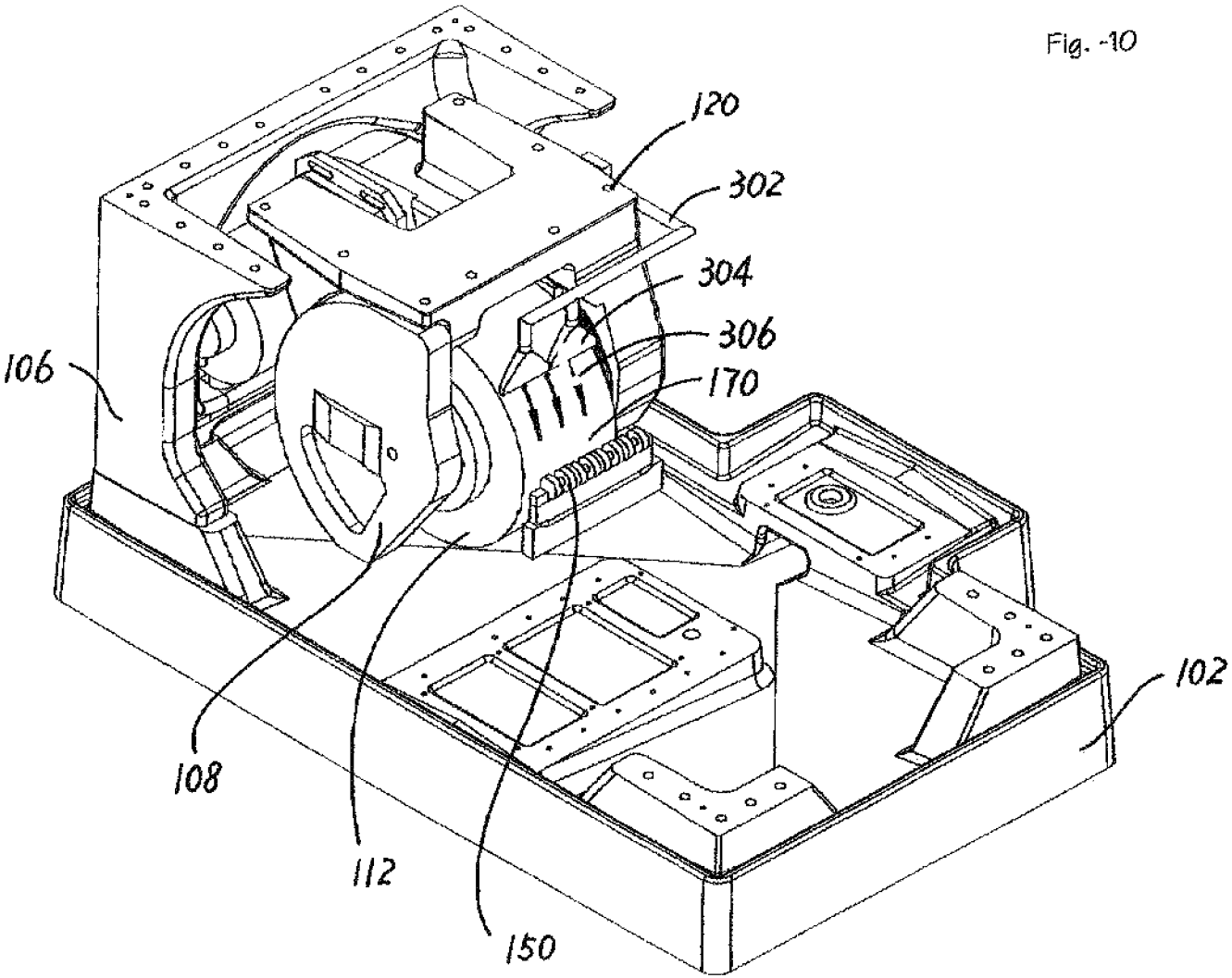
FIG. 10 is a schematic top partial cut away perspective view of the centerless grinding machine showing some selected components.

Referring now to FIG. 10 depicting a partial schematic top perspective view of the centerless grinding machine and in particular it shows the routing of the flow of coolant onto the machine. Coolant feed pipe 302 transports coolant to coolant nozzle 304 onto grinding face 170 of grinding wheel 112. Fluid moves downwardly under gravity along coolant flow lines shown as 306 and splashes onto work piece 150 as well as onto regulating wheel 114 not shown in the diagram.

In prior art devices all of the indexing mechanisms of the grinding wheel 112 and the regulating wheel 114 and also of the grinding wheel dressing diamond 154 and the regulating wheel dressing diamond 156 are generally housed and mounted onto the bottom or the equivalent to lower base 102 of a centerless grinding machine. Generally speaking prior art devices have sliding beds over which grinding wheel housing and the regulating wheel housings move. Most grinding designs have premature wearing problems due to the fact that the rolling or sliding mechanisms are constantly exposed and running in dirty coolant. As a result maintenance to resurface and recalibrate the rolling or sliding surfaces is necessary in order to keep the centerless grinding machine running accurately.

Therefore, a benefit to the current centerless grinding machine 100 depicted and described herein is the fact that the coolant flow 306 is directed downwardly away from the grinding wheel 112 and regulating wheel 114 indexing drives namely grinding wheel linear motor 140 and regulating wheel linear motor 142. In this manner, the indexing mechanisms including the grinding wheel linear motor 140 and regulating wheel linear motor 142, the linear rails 126, 128 and the linear rail saddles 124 remain relatively clean compared to prior art devices in that in the present device they are not constantly operating in dirty coolant fluid.

A person skilled in the art will note that grinding wheel 112 and regulating wheel 114 are supported from above rather than as in the traditional devices from below. A further benefit is derived from this arrangement due to the strong magnetic attraction forces which are created by grinding wheel linear motor 140 and regulating wheel linear motor 142. By way of example only in one of the prototype centerless grinding machines 100 that has been built, the magnetic attraction force created by linear motor 140 amounts to 1200 pounds. The grinding wheel housing 108 combined together with the grinding wheel saddle plate 120 and all of the hardware necessary to attach it to the linear rails 126 amounts to approximately 1000 pounds in weight.

Due to the fact that grinding wheel housing 108 is mounted upside down, the 1200 pound attraction force is almost cancelled out by the 1000 pounds gravitation downward force pulling on the grinding wheel housing 108. This results in a lower net load on linear rails 126 which in turn will result in less wear and longer life of the linear rails 126 and the linear rail saddles 124 which are moving in the lateral grinding direction 160 and the lateral regulating direction 162.

In Use

Centerless grinding machine 100 can be operated in a through feed type setup or in a in feed type set up depending upon the part geometry. Centerless grinding machine 100 is set up and operated as follows:

Firstly grinding wheel dressing diamond 154 and regulating wheel dressing diamond 156 is moved along the Y dressing direction 164 in order to cut a profile onto the grinding wheel 112 and the regulating wheel 114.

Work piece 150 is supported by work piece support 152 and the support is dimensioned such that the part rests against the regulating wheel. The feed of the part into Centerless grinding machine 100 will depend upon the part geometry and may include in feed or through feed type arrangements.

The regulating wheel 114 is driven or rotated by regulating wheel drive motor 222 and indexed or moved in the lateral X regulating direction 162 by regulating wheel linear motor 142 for inward indexing of the regulating wheel. The grinding wheel 112 is driven or rotated by grinding wheel drive motor 220 and indexed or moved in the lateral X grinding direction 160 by grinding wheel linear motor 140 for inward indexing of the grinding wheel. The reader will note that it may not be necessary in all applications for the grinding wheel 112 have the ability to be indexed. In other words in some applications the grinding wheel 112 is stationary.

Indexing or feed rates are selected to produce a course to very fine finish. Regulating wheel 114 is moved laterally along X regulating direction 162 by regulating wheel linear motor 142. Grinding wheel 112 may or may not be indexed along X grinding wheel 160 direction depending upon the application. In some applications grinding wheel 112 is stationary.

Grinding wheel 112 grinds the profile into the work piece 150 and once it is completed the regulating wheel 114 may be indexed along the X regulating direction 162 and in some applications the grinding wheel 112 may be indexed along the X grinding direction 160. The work piece which has now become a finished part is removed from work piece support 152 usually by robotic means and a new work piece 150 is placed upon work piece support 152 and the process starts all over again. This operation may vary depending upon whether the set up is for through feed or in feed of parts.

A person skilled in the art will note that there are a number of advantages to the present centerless grinding machine 100 including the use of linear motors 140 and 142 which result in much higher accuracy in the movement of the grinding wheel 112 in the X grinding direction 160 and the regulating wheel 114 in the X regulating direction 162. It may also be possible to build a similar grinding machine using conventional drives such as ball screw drives and derive some of the benefits listed herein.

Secondly due to the fact that the grinding wheel housing 108 and the regulating wheel housing 110 are mounted upside down being hung from the upper base 104 instead of onto the bottom or lower base 102, penetration and entrapment of debris carried in the cooling water into the indexing drives namely grinding wheel linear motor 140 and regulating wheel linear motor 142 is minimized.

Thirdly coolant flow 306 is downwardly along the grinding face 170 of grinding wheel 112 resulting in the fewer thermal variations particularly of upper base 104. This is beneficial in minimizing thermal deviations in centerless grinding machine 100 since grinding wheel linear motors 140 and regulating wheel linear motors 142 are suspended and supported from upper base 104 rather than from lower base 102. The lower thermal variations result in greater dimensional accuracy and stability of the grinding operation.

Fourthly due to the fact that grinding wheel housing 108 is mounted upside down, the attraction force of the linear motors 140, 142 almost cancels out the gravitation downward force pulling on the grinding wheel housing 108 and regulating wheel housing 110. This results in a lower net load on linear rails 126 which in turn will result in less wear and longer life of the linear rails 126 and the linear rail saddles 124 which are moving in the lateral X grinding direction 160 and the lateral X regulating direction 162.

It should be apparent to persons skilled in the arts that various modifications and adaptation of this structure described above are possible without departure from the spirit of the invention the scope of which is defined in the appended claim.

We claim:

1. A centerless grinding machine comprising:

a) a frame;

b) a driven regulating wheel, a driven grinding wheel and a dressing device mounted to the frame, wherein at least one of the wheels, selected from among the regulating wheel and grinding wheel, is mounted onto at least one linear rail which is mounted to the frame and lying longitudinally along an X direction;

c) at least one of the wheels, selected from among the regulating wheel and grinding wheel, is indexable longitudinally along the linear rail in the X direction, the regulating and grinding wheels for supporting and grinding a work piece placed between the grinding wheel and the regulating wheel;

d) wherein the at least one linear rail is lying longitudinally along the X direction parallel to the indexing direction of the regulating wheel and grinding wheel in a horizontal plane above the work piece, wherein the work piece is located between the grinding wheel and the regulating wheel.

2. The centerless grinding machine claimed in claim 1 wherein both the regulating wheel and the grinding wheel are mounted onto the at least one linear rail.

3. The centerless grinding machine claimed in claim 1 wherein both the regulating wheel and the grinding wheel are mounted onto a common set of at least two linear rails oriented in the horizontal plane.

4. The centerless grinding machine claimed in claim 3 wherein both the grinding wheel and the regulating wheel indexable laterally longitudinally along the X direction.

5. The centerless grinding machine claimed in claim 1 further includes at least one ball screw drive for indexing at least one of the wheels.

6. The centerless grinding machine claimed in claim 1 further includes at least one linear motor for indexing at least one of the wheels.

7. The centerless grinding machine claimed in claim 6 further includes a regulating wheel linear motor and a grinding wheel linear motor for indexing the regulating wheel and the grinding wheel respectively.

8. The centerless grinding machine claimed in claim 7 wherein the linear motors are mounted above a work piece support which is mounted to the base.

9. The centerless grinding machine claimed in claim 1 further includes a set of two parallel and spaced apart linear rails which are rigidly attached to an upper base portion of the frame for operably mounting at least one of the wheels thereto such that at least one wheel indexable longitudinally in the X direction along the linear rails.

10. The centerless grinding machine claimed in claim 9 wherein both the grinding wheel and the regulating wheel are rigidly attached to the set of two linear rails such that both wheels are indexable longitudinally in the X direction along the linear rails.

11. The centerless grinding machine claimed in claim 10 further including a grinding wheel linear motor and a regulating wheel linear motor mounted to the upper base for indexing the grinding wheel and the regulating wheel respectively.

12. The centerless grinding machine claimed in claim 9 further including at least one linear rail saddle for operably connecting at least one of the wheels to the linear rails.

13. The centerless grinding machine claimed in claim 12 further includes at least one saddle plate for connecting at least one wheel to the linear rail saddles.

14. The centerless grinding machine claimed in claim 1 further includes a coolant nozzle mounted to the centerless grinding machine such that coolant flows naturally under gravity downwardly away from the at least one linear rail.

15. The centerless grinding machine claimed in claim 1 wherein the work piece support is mounted to a lower base portion of the frame.

16. The centerless grinding machine claimed in claim 1 wherein the work piece support is mounted to a lower base portion of the frame and moveable in a Y dressing direction.

17. The centerless grinding machine claimed in claim 16 wherein the work piece support includes a regulating wheel dressing diamond and a grinding wheel dressing diamond for dressing a regulating face and a grinding face when the work piece support moved along the Y dressing direction.

18. A centerless grinding machine comprising:

a) a frame;

b) a driven regulating wheel and a driven grinding wheel mounted onto a common set of linear rails, both rails lying longitudinally along an X direction in a common horizontal plane;

c) the grinding wheel and regulating wheel indexable longitudinally along the linear rails in the X direction, wherein the wheels for supporting and grinding a work piece there between;

d) a work piece support for receiving the work piece thereon mounted to the frame between the wheels;

e) wherein the linear rails lying longitudinally in a common horizontal plane above the work piece support.

19. The centerless grinding machine claimed in claim 18 further includes a regulating wheel linear motor and a grinding wheel linear motor for indexing the wheels.

20. The centerless grinding machine claimed in claim 18 wherein the frame includes an upper base wherein the linear rails is mounted to the upper base.

21. The centerless grinding machine claimed in claim 20 wherein the work piece support is mounted to a lower base of the frame.

22. The centerless grinding machine claimed in claim 18 wherein the work piece support is the grinding wheel and the regulating wheel.

23. The centerless grinding machine claimed in claim 18 wherein the work piece support is mounted to the frame.

24. The centerless grinding machine claimed in claim 1 wherein the dressing device is selected from among a cluster point diamond, a single point diamond, a blade style diamond, and a rotary dressing wheel.

25. A centerless grinding machine for grinding a work piece, the machine comprising:

a) a frame and a work piece support attached thereto;

b) a driven regulating wheel, a driven grinding wheel mounted to the frame, wherein at least one of the wheels, selected from among the regulating wheel and grinding wheel, is mounted onto at least one linear rail which is mounted to the frame and lying longitudinally along an X direction;

c) at least one of the wheels, selected from among the regulating wheel and grinding wheel, is indexable longitudinally along the linear rail in the X direction, such that the driven regulating wheel, the driven grinding wheel and the work piece support all contact the work piece simultaneously to carry out grinding of the work piece and to support the weight of the work piece;

d) wherein the at least one linear rail is lying longitudinally along the X direction parallel to the indexing direction of the regulating wheel and grinding wheel in a horizontal plane above the work piece.

* * * * *